United States Patent [19]

Hernberg

[11] Patent Number: 4,971,328

[45] Date of Patent: Nov. 20, 1990

[54] GOLF SWING TRAINER

[76] Inventor: Joseph G. Hernberg, 514 Queen Anne Rd., Cherry Hill, N.J. 08003

[21] Appl. No.: 464,469

[22] Filed: Jan. 12, 1990

[51] Int. Cl.[5] ..... A63B 69/36

[52] U.S. Cl. ..... 273/186 A; 273/DIG. 30

[58] Field of Search ..... 273/186 R, 186 A, 186 AA, 273/186 B, 186 C, 186 D, DIG. 30, 194 A, 183 D

[56] References Cited

U.S. PATENT DOCUMENTS

| | | |
|---|---|---|
| 2,158,211 | 5/1939 | Aitken . |
| 3,070,373 | 12/1962 | Mathews et al. . |
| 3,649,028 | 3/1972 | Worrell . |
| 3,677,553 | 7/1972 | Moore . |
| 3,820,795 | 6/1974 | Taylor . |
| 3,953,034 | 4/1976 | Nelson . |
| 4,456,257 | 6/1984 | Perkins . |

*Primary Examiner*—George J. Marlo

*Attorney, Agent, or Firm*—Caesar, Rivise, Bernstein, Cohen & Pokotilow, Ltd.

[57] ABSTRACT

A golf swing training device comprised of a grip, a foreshortened shaft and a hollow head. The head contains a battery activated by a switch also located within the head, to illuminate a lamp, also within the head. The lamp emits a beam of light downward to the ground and forward of the club head. The light beam permits the golfer to trace the arc of light corresponding to the golfer's swing to impart a mental image to the golfer of the precise club head path. The device also comprises a linear guide strip which is placed on the ground in front of the golfer to establish the desired club head path. The golfer preferably follows the path of the light beam during a swing and compares the light path to the guide strip.

8 Claims, 2 Drawing Sheets

FIG. 1
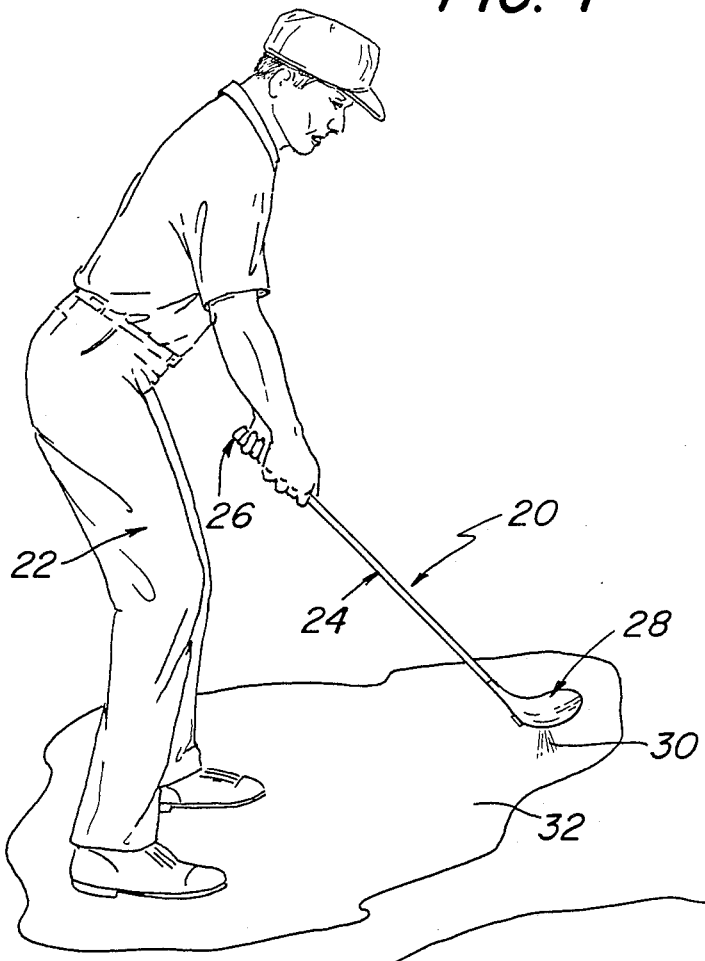
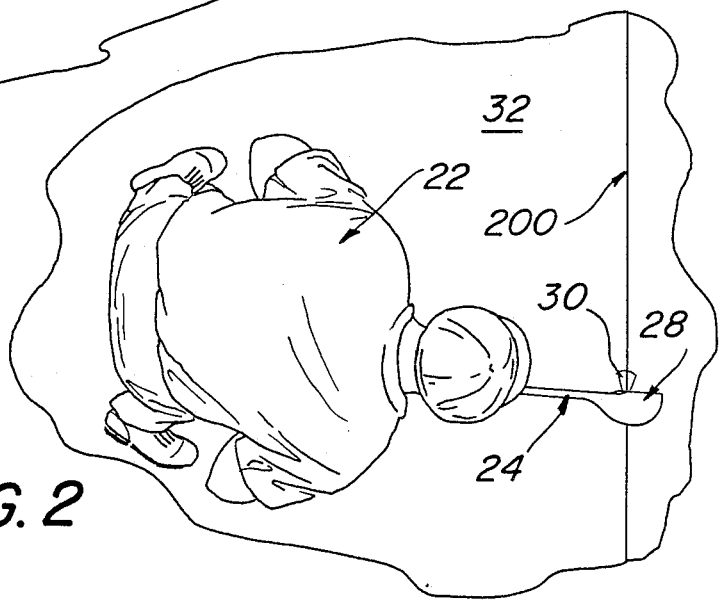
FIG. 2

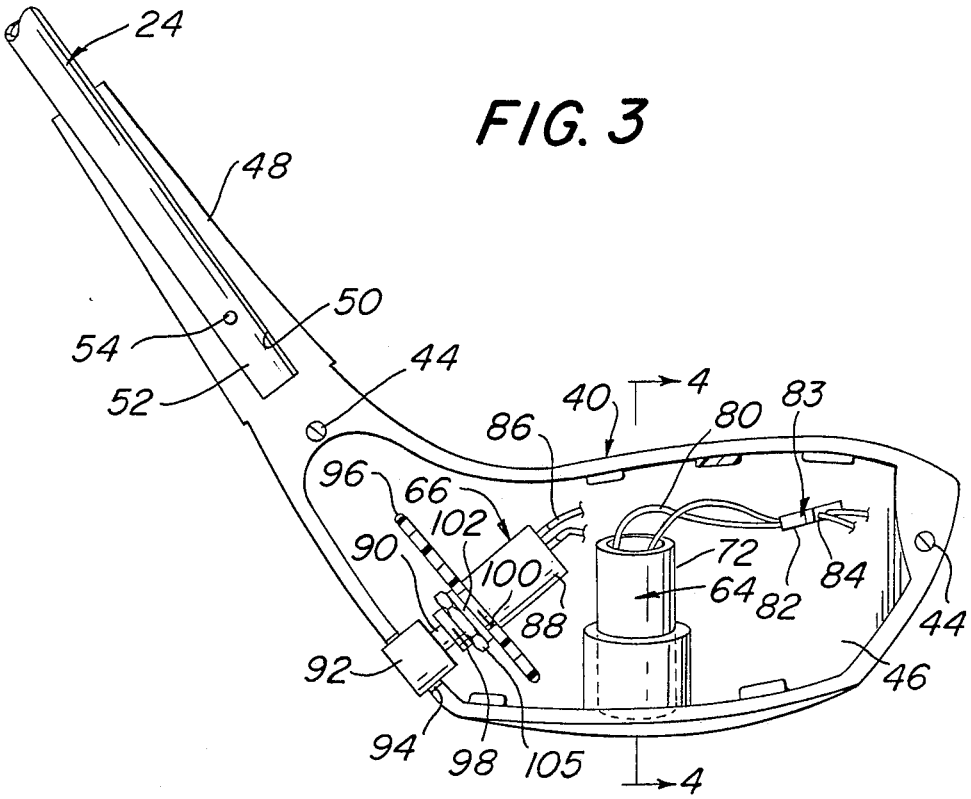
FIG. 3
FIG. 4
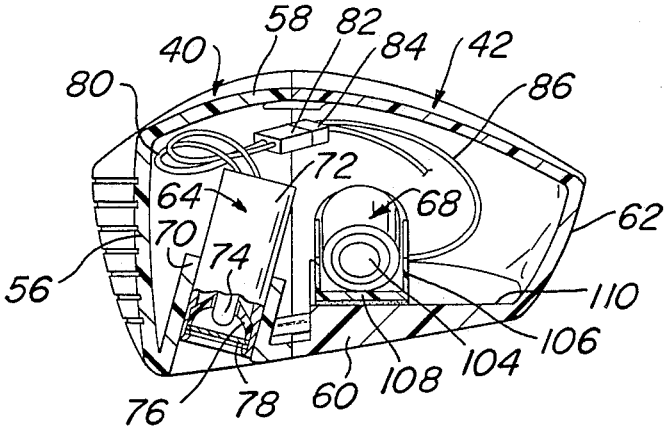

GOLF SWING TRAINER

BACKGROUND OF THE INVENTION

This ivnention relates generally to golf swing training devices, more specifically, to golf swing training devices which are in the configuration of a conventional club and having a foreshortened shaft, but which include means in the head to emit a beam of light to trace an arc of light across the ground as the club is swung to thereby provide a mental image to the golfer of the precise club head path.

Previous devices are designed to assist a golfer in improving the golfer's swing by providing visual assistance to trace and thereby examine his/her swing, to minimize or eliminate technique problems, such as hooking or slicing of the ball.

One such device, U.S. Pat. No. 3,070,373 issued to Donald K. Mathews et al, discloses an attachment to the club shaft. The attachment comprises a light source for projecting a collimated pencil beam of light downwardly onto the ground just ahead of the club and between the golfer and golf ball so that a visually perceived trace of club travel is given so that the golfer and/or instructor are informed of the golfer's swing.

The device disclosed in U.S. Pat. No. 3,953,034 issued to Rodney Nelson discloses a laser beam golf club training device which has a laser beam source attached to or mounted within the club shaft. The laser beam is reflected by a mirror attached to the club head to produce a fan of light to indicate the club head path.

The device disclosed in U.S. Pat. No. 4,456,257 issued to Sonnie Perkins, discloses a golf swing training device which has a light source attached to the club shaft which emits two light beams lengthwise of the shaft to intersect the ground. The light source is wired to a battery pack which is clipped onto the golfer.

In the training device disclosed in U.S. Pat. No. 2,158,211 issued to Matthew Aitken, the club head contains a light source and a pivoted battery support. The device is designed to permit a golfer to determine whether the golf club swing speed is proper. The two-piece shaft is enclosed at the joint by a flexible spring. When the club is swung at the correct speed, due to centrifugal force, the battery moves into engagement with the electrical contact and illuminates the electric bulb. Further, the shaft sections pivot with respect to one another due to angular acceleration imparted to the club by the golfer.

Other golf training devices include generally those disclosed in U.S. Pat. No. 3,677,553 issued to Eric Moore and U.S. Pat. No. 3,820,795 issued to David Taylor, which disclose golf club heads with lights indicating a golfer's swing, the latter further disclosing a battery for the light mounted within the golf club shaft.

The use of ultraviolet light and luminescent strips on a golf club head or chemical light on a golf club head are disclosed in U.S. Pat. No. 3,649,028 issued to Eugene Worrell.

The device of applicant's invention overcomes these and other disadvantages in the prior art by producing a golf swing training device which is low in cost, light weight, simple in construction, and aesthetically pleasing and compact, by enclosing the power source, battery and light source within the club head, in addition to having a foreshortened shaft.

OBJECTS OF THE INVENTION

Accordingly, it is a general object of this invention to provide a golf training device enabling a golfer to visualize the golf club path to correct deficiencies in the golfer's swing.

It is also an object of the invention to provide a golf swing training device having a light beam source projecting downwardly onto the ground just ahead of the club and between the golfer and golf ball so that a visually perceived trace of the club path is permitted.

It is yet a further object of the invention to provide a golf swing training device having a switch-activated light source powered by a battery, all being contained within the club head.

It is also a further object of the invention to provide a golf swing training device which is low in cost, simple in construction and easily transportable due to its foreshortened shaft.

It is yet still a further object of the invention to provide a golf swing training device which is aesthetically pleasing and simulates the appearance of an actual golf club.

SUMMARY OF THE INVENTION

These and other objects of this invention are achieved by providing a golf swing training device which permits a golfer to examine and critique the club head path, and its deviations from the desired swing.

The device comprises a shaft and a head simulating the appearance of a conventional golf club. The shaft is foreshortened so that when the device is swung to simulate the driving of a golf ball, the head is spaced slightly off of the surface upon which the person using the device is standing.

The head comprises a hollow body which contains a self-contained electrical power source means, light generating means for projecting a beam of light out of the head, and switch means for causing the light generating means to produce the beam of light from the electrical power source means. The light generating means is oriented so that the beam of light is projected out of the head toward the surface and slightly forward of the head, whereupon when the person swings the club, the person can freely see the beam of light projected in a path across the surface. This enables the golfer to adjust its swing to a desired path.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a side view of a golfer holding the golf swing trainer of the above invention.

FIG. 2 is a top view of a golfer holding the golf swing trainer of the above invention while utilizing the swing guide marker.

FIG. 3 is an enlarged side elevational view, of one portion of the head of the golf training device of the present invention.

FIG. 4 is an enlarged sectional view taken along lines 4—4 of FIG. 2.

DETAILED DESCRIPTION OF THE PREFERRED EMBODIMENTS

Referring now to the various figures of the drawing wherein like reference numerals refer to like parts there is shown at 20 in FIG. a golf training device constructed in accordance with this invention and being used by a golfer 22 to practice his swing.

The golf training device 20 basically comprises elongated shaft 24 having a conventional grip 26 at its upper end and a head 28 located at its lower end. The head 28 will be described in considerable detail later. Suffice for now to state that it includes means for projecting a beam of light 30 out of the bottom thereof and slightly forward of the front face of the club (to be described later). In use, the golfer swings the club in a conventional manner over the ground or some other surface 32 so that the golfer can see the path of the light beam produced by the club head across the ground. This enables the golfer to "groove" his/her swing.

In accordance with the preferred embodiment of the invention an indicator strip 200 is arranged to be disposed on the ground to provide a club-head trajectory line. That strip can take many forms, such as a strip of plastic. For indoor use, the strip may be arranged to be fixedly secured in place on to the floor or carpeting via the use of VELCRO or some other material, e.g. double sided tape, etc. to prevent it from slipping. Thus, the guide strip 200 provides the golfer with a guide by which he/she may observe and provide the path of the light beam projecting from the club head to the desired path, (as established by the strip) as he/she swings the club in a conventional manner.

In accordance with a preferred aspect of this invention, the golf shaft 24 is foreshortened by approximately eight inches from the standard shaft length to expedite the use of the device. In the preferred embodiment, the shaft has a length of approximately 34 inches (86.36 cm). In this connection, the shortened shaft permits the light beam 30 exiting from the club head 28 (which will be described later in detail) to be readily seen by the user 22 as he/she practices his/her swing. Moreover, golfers may want to practice their golf swing in areas which are too confined for use of a full-length club. Thus, the foreshortened shaft 24 also serves the advantage of minimizing the possibility of damage to furniture or other articles in the areas surrounding the area where the device is used for practice.

The shaft 24 is composed of any suitable rigid, somewhat resilient material. However, in the preferred embodiment the shaft is constructed from a light weight aluminum or steel. The grip 26, which is located at the top of the shaft, is fixedly secured thereto in any conventional manner, e.g., adhesive. The grip is preferably comprised of any suitable material to enable the golfer to maintain a firm, comfortable grip on the device. Thus, any conventional grip material can be used.

Before discussing the construction of the club head 28 it should be noted that in the embodiment shown herein the head is in the form of a typical "wood" type head. Such a construction is preferred inasmuch such a head provides the most interior space (as compared to a "iron" head) for the components producing the light beam 30. However, it is contemplated that other style heads can be utilized in lieu of the wood-style head shown and described herein.

Turning now to FIGS. 3 and 4, the details of the head 28 will now be considered.

The club head 28 basically comprises two sections 40 and 42. The sections are preferably molded of a high impact plastic and each is hollow. The two sections are assembled together via screws 44 to create a hollow interior cavity 46 for the electrical components of the device. The section 40 constitutes the front section of the head 28, while the section 42 constitutes the club head rear section. The front section 40 and the rear section 42 each include a neck portion 48 projecting upward therefrom. The neck portions when joined together form a hollow bore 50 into which the lower end 52 of the shaft 24 is secured, via at least one screw 54. In addition, an adhesive (not shown) may be used to aid in the securement of the shaft to the club head neck.

When the two sections 40 and 42 are secured together they form the heretofore identified club head 28. As can be seen in FIG. 4, that club head includes a front wall portion 56, a top wall portion 58, a bottom wall portion 60, and a rear wall portion 62. The front wall portion 56 has the outer surface appearance of a conventional ball impacting surface of a club. To that end it includes parallel grooves in its surface.

The means for producing the light beam 30 basically constitutes a lamp assembly 64, an on/off switch assembly 66, and a power source 68. The lamp assembly 64 is mounted within a tubular well 70 which projects upward at an acute angle from the bottom surface of the bottom wall 60 of the club head 28. The well is open at its bottom to form the outlet through which the light beam 30 projects.

The lamp assembly 64 basically comprises a cylindrical housing 72 in which is located a conventional lamp or bulb 74. In a preferred embodiment of the invention the bulb is preferably a one watt krypton bulb. Preferably, the lamp utilized produces a diffuse beam of light to form a cone of light which is more easily perceived. However, it should be readily apparent to those skilled in the art that other types of beams may be produced, e.g., collimated, etc., by substitution of the bulb for another type. Disposed about the front of the bulb is a conical reflector element 76. The reflector element is held in place in the front portion of the lamp assembly housing 72. A transparent lens 78 is disposed immediately adjacent the bulb 74 and the reflector 76 within the lamp assembly housing front (lower) end. Thus, when the lamp assembly 64 is disposed within the well, the lamp faces downward so that its light passes through the lens out the opening at the bottom of the well to be directed downwardly and forwardly of the front surface 56 of the club head.

The lamp assembly 64 may be held in place either by a fictional fit or by some other releasable securement means (not shown) so that the assembly can be removed, if desired, for servicing or replacing. A conventional pair of wires 80, extend from the lamp assembly. These wires terminate in one portion 82 of a connector 83. The other portion 84 of the connector is connected to other wires 86 which are connected in series with the switch assembly 66 and the power source 68, as is conventional.

The switch assembly 66 basically comprises a switch body 88 in which the switch components are mounted. The actuator of the switch is denoted by the reference numeral 90 and includes at its free end an enlarged head or push button 92. That head or push bottom extends through an opening 94 in the club head adjacent the neck portion 48. The switch 66 is fixedly mounted within the club head cavity 46 via a mounting wall 96 which is formed integrally with the front head section 40. The switch assembly includes a threaded neck 98 which extends through a hole 100 in the mounting wall 96, a lock washer 102, and lock nut 105 are provided on the threaded neck 98 of the switch to secure it to the wall 96.

The power source 66 is best seen in FIG. 4 and basically comprises a conventional battery, such as a "C-type" 1.5 volt cell. The battery or cell 104 is disposed within a carrier or holder 106.

The holder is fixedly secured via an adhesive layer 108 to the inner surface 110 of the bottom wall 60 of the club head. The battery holder 106 includes a pair of terminals (not shown) to which the heretofore identified wires are connected so that the battery is connected in series with the switch 66 and lamp 74. Thus, one of the terminals is arranged to be engaged by the anode of the battery 104 when the battery is located within the holder 106 while the other terminal is arranged to be engaged by the cathode of the battery.

The switch 66 is arranged such that when its push button 92 is depressed it closes, whereupon electric current is provided to the lamp 74 to energize it and thereby produce the downwardly and forwardly extending beam 30. The device is now ready to be used by the golfer to practice his/her swing. After use, the push button 90 may again be depressed, whereby the switch opens so that the bulb is no longer illuminated, thereby conserving battery power.

As should be appreciated from the foregoing, the training device of the subject invention is simple in construction, can be manufactured at a relatively low cost, can be used either indoors or outdoors in relatively confined areas, yet provides an excellent method of enabling a golfer to "groove his/her swing" by watching the path of the moving beam of light 30 across the ground or the marker indicia 200.

The club head of the present invention is aesthetically pleasing in that it resembles a conventional head, yet, contains the light source, power source and switch, so that none is readily visible. This feature further contributes to the aesthetically pleasing appearance of the device. Moreover, the fact that all the components are contained with the club head renders it readily transportable, easy to use, and less likely that the components are damaged during storage and/or transport.

By virtue of the fact that the club head is formed in two sections which are releasably secured together via the screws 44, easy access to the interior of the head is provided for servicing or replacement of any of the components. Thus, for example if the lamp assembly malfunctions, all that is necessary for repair is to disconnect the connector sections 82 and 84, remove the lamp assembly 64 from the well 70 and replace it with another lamp assembly or with the old lamp assembly having a new bulb in it. Replacement of the battery is easily effected by merely snapping it out of its holder. The switch 90 can be readily replaced by unfastening the locking nut and removing the switch from the mounting wall 98.

Without further elaboration the foregoing will so fully illustrate my invention that others may, by applying current or future knowledge, readily adapt the same for use under various conditions of service.

I claim:

1. A golf club training device to be used by a person comprising a shaft and a head simulating the appearance of a conventional golf club, said head having a front face, said shaft being foreshortened so that when said device is swung to simulate the driving of a golf ball, said head is spaced slightly off of the surface upon which said person using said device is standing, said head comprising a hollow body, containing self-contained electrical power source means, light generating means, and switch means, said light generating means being arranged for projecting a beam of light out of said head, said switch means being connected to said light generating means and said power source means for causing said light generating means to produce said beam of light from said electrical power source means, said light generating means being oriented with respect to said hollow body so that said beam of light is projected out of said head toward said surface and slightly forward of said front surface of said head, whereupon when said person swings said golf club training device, said person can freely see said beam of light projected in a path across said surface to enable said person to adjust said swing to a desired path.

2. The device of claim 1 wherein said power source means comprises a battery.

3. The device of claim wherein said light generating means comprises a bulb.

4. The device of claim 3 wherein said bulb means comprises a krypton bulb.

5. The device of claim 1 wherein said head comprises a first section releasably secured to a second section.

6. The device of claim 1 further comprising a guiding indicia means to be located on said surface directly in front of said person.

7. The device of claim 6 wherein said guiding indicia means comprises a linear strip and means for mounting said linear strip to said surface.

8. The device of claim 1 wherein said beam of light is diffuse.

* * * * *